United States Patent [19]

Iwata et al.

[11] 3,949,498

[45] Apr. 13, 1976

[54] GRAB BUCKET FOR DREDGING SLUDGE

[75] Inventors: Hisao Iwata; Gentaro Hasewaga; Kameichi Shimizu, all of Chiba, Japan

[73] Assignee: Mitsubishi Seiko Kabushiki Kaisha, Japan

[22] Filed: Oct. 30, 1974

[21] Appl. No.: 519,120

[52] U.S. Cl. ..... 37/187; 37/71; 294/70

[51] Int. Cl.[2] ..... E02F 3/44

[58] Field of Search..... 37/71, 183 R, 183 A, 186, 37/187, 188, 184, 185; 214/656–658; 294/70

[56] References Cited

UNITED STATES PATENTS

| | | | |
|---|---|---|---|
| 671,134 | 4/1901 | Hasz | 37/187 |
| 827,635 | 7/1906 | Hone | 37/187 |
| 921,056 | 5/1909 | Andresen | 37/186 |
| 1,097,317 | 5/1914 | Hatt | 37/186 |
| 1,464,718 | 8/1923 | Lovell | 37/188 X |
| 1,544,969 | 7/1925 | Cooper et al. | 37/187 |
| 1,817,595 | 8/1931 | Wallace | 37/186 |
| 2,177,196 | 10/1939 | Williams | 37/187 X |

FOREIGN PATENTS OR APPLICATIONS

| | | | |
|---|---|---|---|
| 311,582 | 5/1929 | United Kingdom | 37/183 R |
| 33,494 | 8/1934 | Netherlands | 37/184 |
| 323,359 | 1/1930 | United Kingdom | 37/187 |
| 1,276,483 | 10/1961 | France | 37/184 |

*Primary Examiner*—Clifford D. Crowder
*Attorney, Agent, or Firm*—Amster & Rothstein

[57] ABSTRACT

A grab bucket particularly suitable for dredging the bottom of the sea, rivers, lakes, etc. is provided with bottom plates at the lower portion of a framework from the bottom of which pivotally hang a pair of bucket shells, whereby the bottom plates cooperate with the bucket shells to shield their upper openings when they are swung upwards about their pivotal portions to put their respective confronting edges tightly together in a conventional manner.

5 Claims, 2 Drawing Figures

GRAB BUCKET FOR DREDGING SLUDGE

BACKGROUND OF THE INVENTION

This invention relates to a grab bucket and more particularly to a grab bucket especially suitable for dredging sludge accumulated on the bottom of the sea, rivers, lakes, etc.

Hitherto it has been wellknown that when the sludge accumulated on the bottom of the sea, rivers, lakes or the like is dredged by a conventional grab bucket comprising a pair of bucket shells, during the winding up movement of the bucket from the bottom of the sea, etc. to the surface, the sludge exposed over the upper openings of the shells constituting the grab bucket is washed down by the surrounding water moving relative to the bucket so that the water around the dredging area is vastly polluted. On the other hand, on dredging the bottom of the sea, etc., should the grab bucket drive too deeply into the soft mud on the bottom so that it is apt to take up too much sludge, pollution of the water may also be caused near the bottom due to the unnecessary agitation of the sludge accumulated on the bottom.

SUMMARY OF THE INVENTION

An object of the present invention is to provide a grab bucket comprising a pair of bucket shells which can avoid scattering the content grasped in the shells during its movement after the shells have been closed with the content received therebetween.

Another object of the present invention is to provide a grab bucket comprising a pair of bucket shells which can avoid the bucket shells driving too deeply into the content to be grasped even though the bucket strikes against it at a relatively high speed with the bucket shells open.

In accordance with this invention a grab bucket is provided which is particularly suitable for dredging operations and which comprises a framework having generally a rectangular hollow vertical space within it, vertically shiftable means constrained within the hollow vertical space of said framework for a confined up and down movement, a pair of bucket shells each having opposed side walls and a bottom plate connecting the bases of said side walls, each of said bucket shells being pivotally connected by hinges, near the upper side of its bottom plate to said framework near each one of its opposed bottom sides, link means pivotally connecting said vertically shiftable means at its lower portion to said respective bucket shells at the upper inner portions of said side walls, whereby said link means keep said pair of bucket shells opened by their dead weights when said lowering means is at its lowermost position, whereas they keep the bucket shells closed with the confronting edges of said side walls and said bottom plates fitting tightly together when said lowering means is at its uppermost position, and bottom plates provided at the under surface of said framework so as to tightly shield the openings formed at the upper edges of said bucket shells.

The present invention contemplates also to connect both side walls of each of said bucket shells near the portions pivotally connected to said link means by a cover plate having a substantial length so that said cover plate cooperates with said bottom plates of said framework to more completely shield the upper openings of said bucket shells when they are closed. Further said cover plates serve to prevent said bucket shells from being driven too deeply into the bottom of the sea etc. when the opened bucket shells strike against the bottom at a relatively high speed.

With the provision of said bottom plates for said framework and said cover plates for said bucket shells in the present invention the washing out action of the content contained in said bucket shells usually caused by the surrounding water as they move in the water can be effectively avoided, because the openings of the bucket shells are substantially closed by the bottom and cover plates. Also the provision of said cover plates for said bucket shells in the present invention effectively avoids the contamination of water when they strike against the bottom of the sea etc., because they do not drive into the bottom unnecessarily deeply.

BRIEF DESCRIPTION OF THE DRAWINGS

These and other objects of this invention will become more readily apparent upon a reading of the following specification and upon reference to the accompanying drawings, in which.

DESCRIPTION OF THE PREFERRED EMBODIMENT

Figure 1:
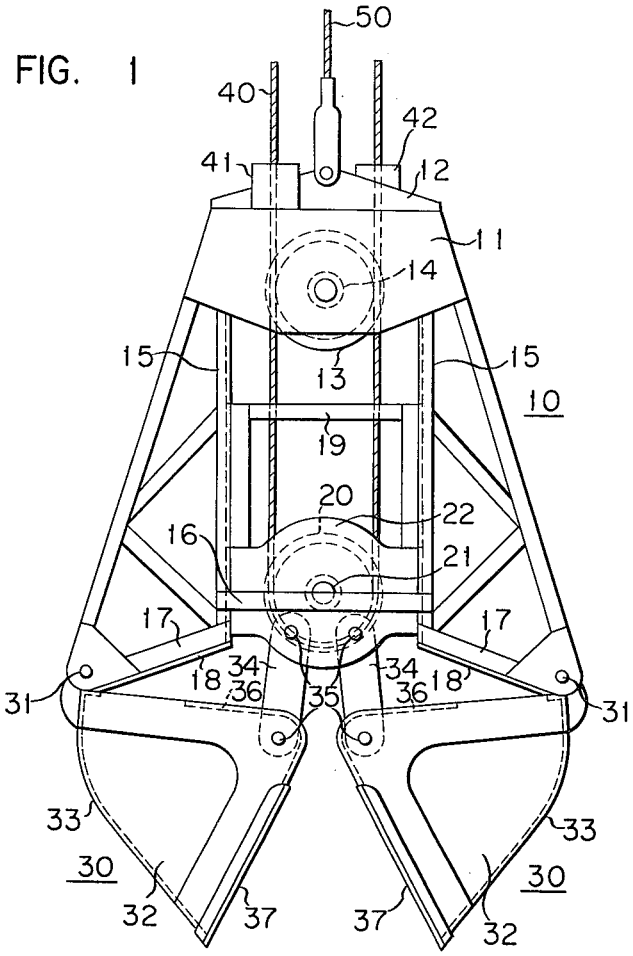
FIG. 1 is a side elevational view of one embodiment of the present invention with its bucket shells open.

Referring to FIG. 1 a framework of a grab bucket is shown generally illustrated at numeral 10, comprising a pair of parallel side frames each having a symmetrical trapezoidal configuration as shown and a pair of second side frames each connecting the confronting sides of the parallel side frames. The framework 10 may be fabricated in known manner from e.g. steel angle bars and steel plates by any suitable means such as welding. Though the framework 10 has been described and illustrated to have such a specific configuration, it may have any other desired configuration so long as it has a vertical hollow space within it to receive a lowering block to be explained later. Integrally secured at the upper portion of the framework 10 is an upper block 11 which is fabricated from e.g. steel plates by any suitable means such as welding so as to form generally a hollow construction with its top being covered by a ceiling plate 12, but opened at its bottom. Rotatably mounted in the hollow space of the upper block 11 is an upper guide pulley 13 on a horizontal shaft 14 rigidly secured to its confronting parallel walls, whereby the guide pulley 13 is rotatably kept on the shaft 14 at its midportion with its axial movement being prevented by any suitable means. Further, rigidly secured to the framework 10 within its hollow space are pairs of guide rails 15 each preferably made of a steel angle bar, each pair of them being disposed with their outer faces contacting the inner surfaces of the confronting parallel walls of the upper block 11, whereby each of the guide rails 15 is arranged so as to be symmetrical with respect to the vertical center line of the framework 10. The lower ends of the respective guide rails 15 terminate in a horizontal plane disposed somewhat higher than that passing through the respective lower ends of both confronting trapezoidal side frames of the framework 10. The adjoining guide rails 15, i.e. those lying in planes parallel with the confronting trapezoidal side frames of the framework 10 and those lying in planes perpendicular to them are rigidly connected with each other at their lower portions through horizontal distance bars 16, each preferably made of a steel angle bar, respectively rigidly secured at each end to the outer faces of the respective guide rails 15 by any suitable means such as welding. Each lower end of the respective guide rails 15 is further rigidly connected to the confronting lower ends of the respective trapezoidal side frames of the framework 10 through suitable steel angle bars 17, etc., secured at their ends to both members by any suitable means such as welding. Further, each pair of the steel bars 17 disposed in parallel with each other firmly secure at their under surfaces a cover plate 18 made of a suitable steel plate, having generally a rectangular configuration, by such means as welding. In this case, it will be appreciated that due to the height of the lower ends of the guide rails 15 above the horizontal plane connecting the lower ends of the trapezoidal side frames of the framework 10 as abovementioned, each cover plate 18 inclines upwards toward the vertical center line of the framework 10 so as to provide a symmetrically tapered partial bottom for the framework 10, a rectangular opening being left thereby between the upper sides of the respective cover plates 18. Shiftably disposed within the rectangular prismatic space formed by the guide rails 15 is the lowering block 19 which has generally a similar rectangular prismatic configuration and is fabricated from steel angle bars and steel plates by such means as welding. The lowering block 19 is designed to be smoothly shiftable up and down guided by the guide rails 15, and, if necessary, any suitable friction reducing means such as rollers may be disposed between them to insure a smooth motion. The lowering block 19 has also a lower guide pulley 20 which is rotatably mounted on a horizontal shaft 21 that is secured at each end to each of a pair of steel side plates 22 which are rigidly secured to the lower portion of the lowering block 19, by such means as welding, in parallel with the trapezoidal side frames of the framework 10, whereby both horizontal shafts 14 and 21 are arranged so as to vertically align with each other. The lower guide pulley 20 has a similar dimension to that of the upper guide pulley 13 and is rotatably mounted on the shaft 21 in such a manner that the lower guide pulley 20 is disposed directly under the upper guide pulley 13 with its axial movement being prevented by any suitable means.

At each pair of the confronting lower ends of the sides of the trapezoidal side frames of the framework 10 two confronting upper outer ends of each of a pair of grab shells 30 are rotatably hinged by means of hinge pins 31. Each shell 30 comprises a pair of confronting side walls 32 each having generally a triangular configuration with a somewhat convex base as well as a rounded apex and a bottom plate 33 connecting the bases of the side walls 32. In this case, each triangular configuration of the side walls 32 is defined such that when the bucket shells 30 are swung upwards about the hinge pins 31 by pulling it inwardly upwards at its apex its upper side comes into contact with the under surface of the tapered bottom plate 18 of the framework 10, whereas its lower side comes into alignment with the vertical center line of the framework 10. The grab shells 30 are preferably made of steel plates and necessary reinforcements made of steel forgings or steel castings so as to resist the shock and wear they are to be subjected to during a severe dredging operation. The apices of the side walls 32 of each of the bucket shells 30 are respectively pivotally connected to the side plates 22 of the lowering block 19 at their lower portions, symmetrically spaced at a distance from the vertical center line of the framework 10, through respective links 34 by means of pivot pins 35 respectively secured to the shells 30 and the lowering block 19. The lengths of the links 34 are selected such that when the lowering block 19 is at its lowermost position the respective bucket shells 30 are swung outwardly downwards by their dead weights to separate from each other. Further, each of the shells 30 is provided with a reinforcement or cover plate 36, preferably made of a steel plate, in the range of the apices of the triangular side plates 32 so as to be arranged along the roundings of the outer edges of the apex portions in the directions of both sides for a substantial length. In this case, care should be taken to make the outer surface of the reinforcement plate 36 flush with the peripheries of the apex portions of the triangular side plates 32 and also to cut out suitable slots between them and the inner surfaces of the side walls 32 so as to allow the free swinging of the links 34 when they operate.

Further, the lower sides of the triangular side walls 32 and the lower edge of the bottom plate 33 of each of the grab shells 30 are lined with a seal packing 37 made of an elastic material such as hard rubber so that when both shells 30 are swung upwards about respective hinge pins 31 until the upper sides of the side walls 32 come into contact with the bottom plates 18 of the framework 10 the lower sides of the triangular side walls 32 and the lower edges of the bottom plates 33 are put tightly together, thereby assuring the prevention of the content grasped within the closed grab shells 30 from leaking through the contact edges of the side walls 32 and the bottom plates 33.

In order to effect the closing and opening of both bucket shells 30, as usual in the conventional grab buckets, a wire rope 40 passed through an opening 41 formed in the ceiling plate 12 of the upper block 11 is reeved around the lower periphery of the lower guide pulley 20 and fed upwards through another opening 42 formed in the ceiling plate 12, whereby the wire rope 40 is guided by the upper guide pulley 13 arranged above the lower guide pulley 20 for insuring the smooth running of the wire rope 40 in either direction.

Figure 2:
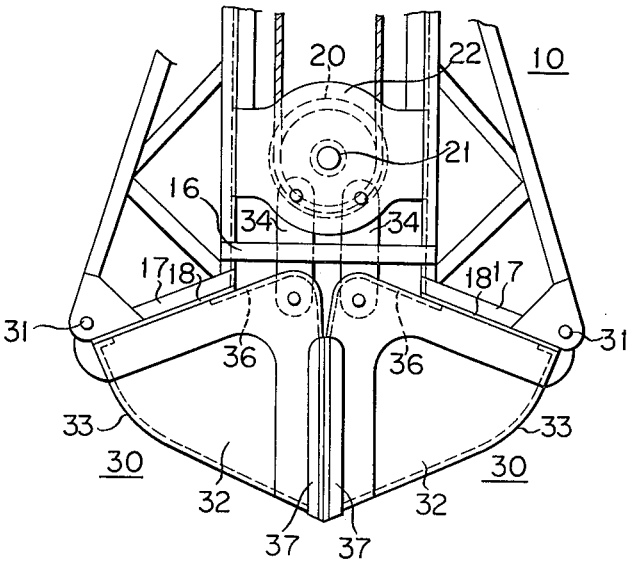
FIG. 2 is a view similar to FIG. 1, but with the bucket shells closed, with a part being eliminated from the drawing for clarity.

Thus, as usual in the conventional grab buckets, when the grab bucket assembly is suitably hung from e.g. dredging machines through wire ropes 50 secured to the top of the ceiling plate 12 of the upper block 11 and the wire rope 40 is pulled upwards by any suitable means from the state as shown in FIG. 1 in which both grab shells 30 are kept open with the lowering block 19 being at its lowermost position, the lowering block 19 is raised along the guide rails 15 due to the winding up of the lower guide pulley 20 by the wire rope 40 to its uppermost position, resulting in the lifting of the links 34, which in turn make the respective grab shells 30 swing upwards about their pivot pins 31 until the upper sides of the triangular side walls 32 come into contact with the under surfaces of the bottom plates 18 of the frame-work 10 and at the same time the lower sides of the triangular side walls 32 and the lower edges of the bottom plates 33 are put tightly together, the elastic seal packings 37 intervening therebetween as shown in FIG. 2.

It will be appreciated that when both grab shells 30 are closed with the content to be grasped received therebetween the upper openings shaped between the upper sides of the respective triangular side walls 32 and the upper sides of the bottom plates 33 are substantially shielded by the bottom plates 18 and at the same time the outer portions of the reinforcement plates 36 provided at the regions of the apices of the triangular side walls 32 of the bucket shells 30 overlap the underside of the portions of the bottom plates 18 of the framework 10, so that, coupled with the tight sealing of the opposing edges of the side walls 32 and the lower bottom plates 33 of the bucket shells 30 by the seal packings 37, the scatter of the content within the bucket shells 30 out of their openings is effectively prevented.

It will also be appreciated that the driving of the opened bucket shells 30 too deeply into the material to be grasped when they strike against it is effectively prevented by the resistances of the reinforcement plates 36 of the bucket shells 30 caused by their striking against the material.

Thus, it will be apparent that the prevention of the scatter of the content out of the bucket shells as well as their driving too deeply into the material to be grasped effectively serves to solve the pollution problems in the dredging operations of the sea bottom, etc.

Though the present grab bucket has been described and illustrated above as it is used for the dredging of the sea bottom, etc. it will be appreciated that the present invention is also applicable equally to handle granular or powdered materials such as grain for the purpose of preventing their scatter during the movement of the bucket or of its driving too deeply into them.

While we have described and illustrated herein one preferred embodiment of our invention it will be appreciated that modifications may be made without departing from the spirit of our invention.

What is claimed is:

1. A grab bucket for dredging sludge comprising frame means including spaced vertical guide members within which block means is in contact with and vertically shiftable between upper and lower locations on said vertical guide members;

support means attached to each said vertical guide member at said lower location and extending outwardly therefrom;

a pair of bucket shells each formed by spaced, generally triangularly-shaped side walls connected by a bottom plate member;

hinge means located at outer extensions of said support means, and link means connected to said block means;

said triangularly-shaped side walls of each said bucket shell having one corner thereof connected with said hinge means and further having a spaced adjacent corner connected with said link means whereby vertical movement of said block means and connected link means moves said bucket shells between open and closed positions;

a pair of cover plates, one each mounted on said support means and extending therealong from said vertical guide member attachment to said hinge means location; and a pair of reinforcement plates, one each extending between and mounted along top portions of said spaced side walls of each said bucket shell, each said reinforcement plate extending outwardly from at least said corners connected with said link means to an intermediate distance, each said reinforcement plate positioned in overlapping relation with each said respective cover plate when said bucket shells are in the closed position.

2. A grab bucket according to claim 1 wherein said support means are formed as parallel bars on each side of each said vertical guide member and extend therefrom at a downward inclination.

3. A grab bucket according to claim 2 wherein each said cover plate has a rectangular shape and extends between said parallel bars.

4. A grab bucket according to claim 1 wherein said corner of each said side wall connected to said link means is rounded, each said reinforcement plate has a corresponding rounded shape to fit in abutting relation with said rounded corner, and each said reinforcement plate extends from said corner along adjoining side walls.

5. A grab bucket according to claim 4 wherein each said reinforcement plate includes slot means through which said link means extends in providing the connection between said side walls and said block means.

* * * * *